United States Patent [19]

Nishijima

[11] Patent Number: 4,681,423

[45] Date of Patent: Jul. 21, 1987

[54] COPYING MACHINE HAVING A CONTROL PROCESS TO REDUCE COPYING TIME

[75] Inventor: Masaru Nishijima, Hirakata, Japan

[73] Assignee: Sharp Kabushiki Kaisha, Osaka, Japan

[21] Appl. No.: 775,307

[22] Filed: Sep. 12, 1985

[30] Foreign Application Priority Data

| | | | |
|---|---|---|---|
| Sep. 14, 1984 | [JP] | Japan | 59-193437 |
| Sep. 14, 1984 | [JP] | Japan | 59-193438 |
| Sep. 17, 1984 | [JP] | Japan | 59-195239 |

[51] Int. Cl.[4] ..... G03G 15/12

[52] U.S. Cl. ..... 355/14 R; 355/3 FU; 355/30; 355/14 FU

[58] Field of Search ..... 355/14 FU, 3 FU, 14 R, 355/30; 219/216

[56] References Cited

U.S. PATENT DOCUMENTS

| | | | |
|---|---|---|---|
| 3,976,374 | 8/1976 | Hickman | 355/14 R |
| 4,324,486 | 4/1982 | Nishikawa | 355/3 FU |
| 4,367,036 | 1/1983 | Sakamaki et al. | 355/30 |

*Primary Examiner*—R. L. Moses

*Attorney, Agent, or Firm*—Birch, Stewart Kolasch & Birch

[57] ABSTRACT

In an electrophotographic copying machine in which a warming up operation is performed before a copying operation is initiated. This warming up operation is for preliminarily warming up various devices such as a fixing device and a photoreceptor drum. In this copying machine, a device is provided for performing the warming up operation in accordance with a signal generated by operation of any one of the keys for setting copy nubmer, for setting copy magnification or for selecting size of a copy paper and/or a signal of an original detecting sensor.

6 Claims, 9 Drawing Figures

COPYING MACHINE HAVING A CONTROL PROCESS TO REDUCE COPYING TIME

FIELD OF THE INVENTION

The present invention relates to a copying machine and particularly to a control process of the copying machine for cutting down copying time to complete a first copy of an original.

BACKGROUND OF THE INVENTION

In general, in the surrounding of a photoreceptor drum in an electrophotographic copying machine, a corona charger, an exposure unit, a developing unit, a copy unit, a charge eraser and a cleaning unit are arranged. The copying machine also comprises transfer unit for transferring the copy paper to the said copy unit and transferring to a fixing unit after copying. Normally, as soon as copying is completed, the above copying machine stops all the operating units including the corona charger and set a waiting condition in order to take account into the life of the photoreceptor drum and the mechanical units. When the next copy operation is performed, a warming up operation of all the operating units including the corona charger is repeatedly performed.

In the above copying machine, a warming up operation before copy operation is performed in order to stabilize the photoreceptor drum, as well as copy operation, wherein in the warming up operation the photoreceptor drum is rotated without copy paper, then feeding and transferring a copy paper is not performed. It takes relatively long time to complete a first copy of an original because the first copy operation is performed after the warming up operation. Particularly, when a lot of original are copied, it takes much time to copy all the original because the warming up operation is performed every time the original is changed.

SUMMARY OF THE INVENTION

An essential object of the present invention is to provide a copying machine which reduces the time required to complete a first copy of an original.

According to the present invention, there is provided an electrophotographic copying machine for making a copy of an original located on an original platform, said copying machine comprising means for performing a warming up operation of necessary devices including a photoreceptor drum and fixing device provided in the copying machine, means for performing copying operation in accordance with an operation of a copy switch and control means for performing the said warming up operation in accordance with an order signal generated before the operation of the copy switch. In the copying machine when one of signals for ordering a warming up operation which is a signal of any one of the keys of such as magnification setting keys, copy number setting key and so on and/or an original detecting signal is inputted to the control means, the warming up operation is performed before copy operation. Accordingly, as soon as a copy start switch is operated, the copy operation begins. Accordingly, the copying time to complete a first copy of an original can be decreased.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENT

Figure 1:
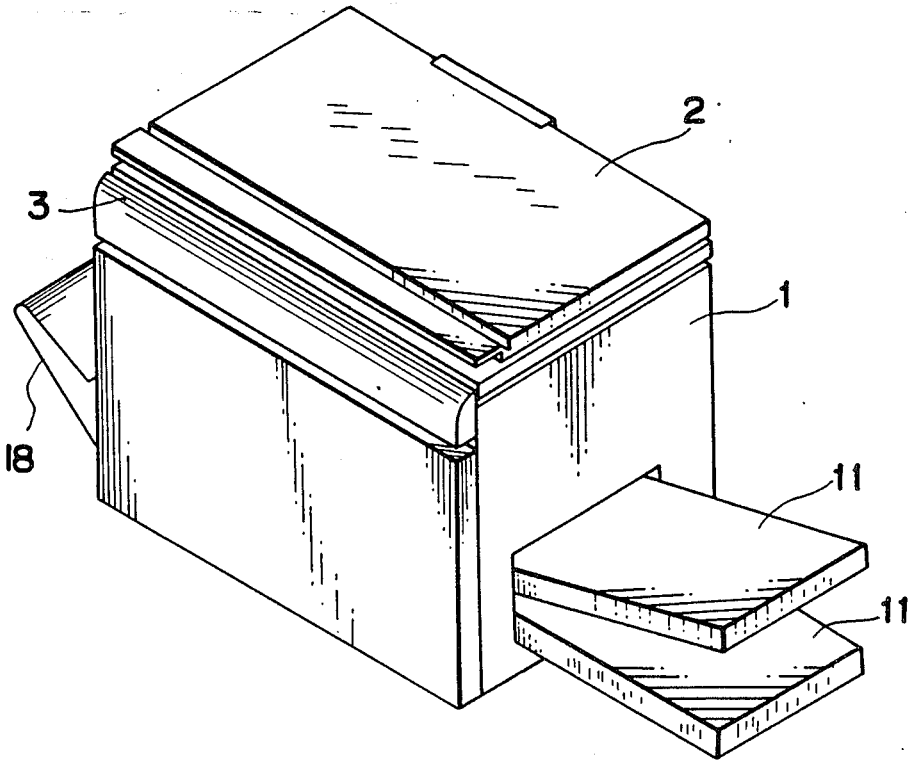
FIG. 1 is a schematic side view of an embodiment of an electrophotographic copying machine according to the present invention.

Referring to FIG. 1, an electrophotographic copying machine 1 comprises an original pressing cover 2 for covering an original platform and a copy operation unit 3.

Figure 4:
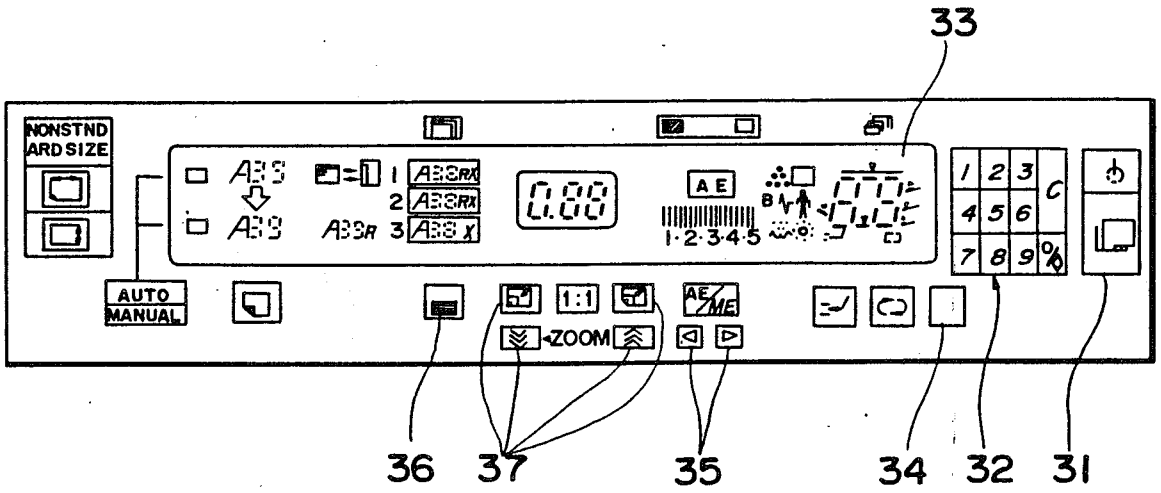
FIG. 4 is a top plan view showing a copy operation unit used in the copying machine shown in FIG. 1.

As shown in FIG. 4, the copy operation unit comprises a copy switch 31 for setting the copy operation, numeral keys 32 of 0–9 for setting a number of copy paper, a display unit 38 for displaying the number of copy paper etc., and an operation key 34 for performing a warming up operation according to the present invention when original is changed. The copy operation unit also comprises a key 35 for adjusting copying density, a selecting key 36 for selecting one of plural paper cassettes arranged in the copying machine 1 and a copy magnification setting key 37 for setting copy magnification.

Figure 2:
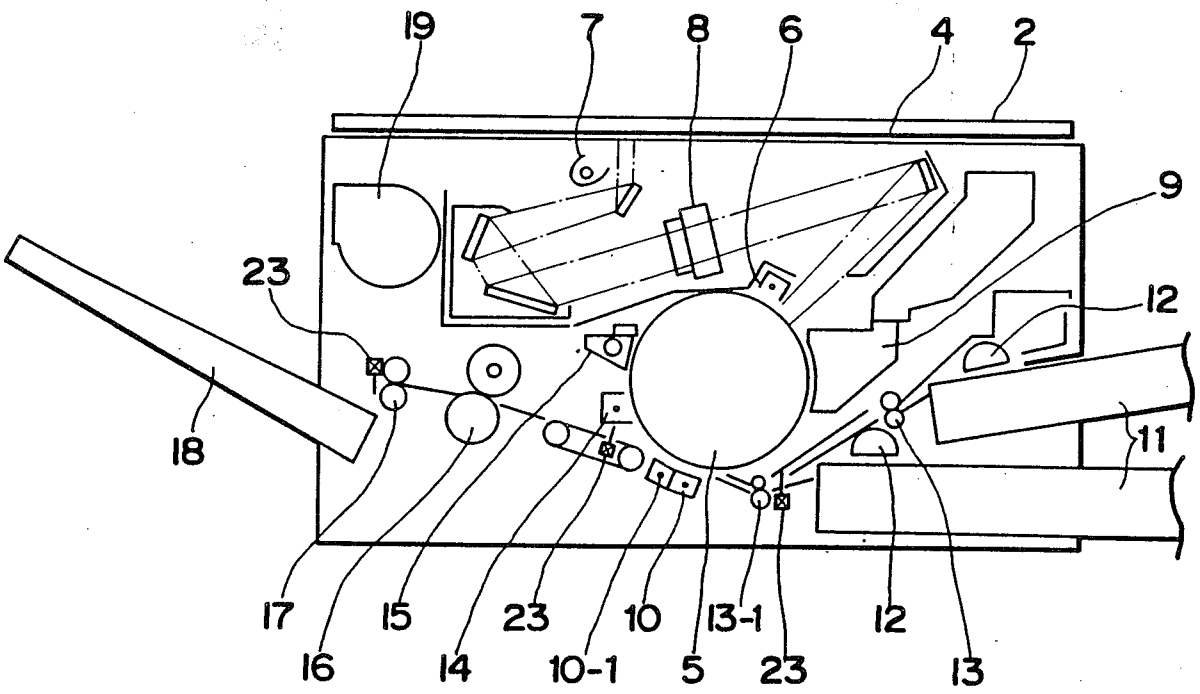
FIG. 2 is a perspective view showing an essential portion of the electrophotographic copying machine shown in FIG. 1.

In FIG. 2, numeral 5 denotes a photoreceptor drum, 6 denotes a corona charger, 7 denotes a light source for lighting an original on an original platform 4, and 8 denotes an optical system comprising a mirror for reflecting a light image of the original and a lens for focusing on the photoreceptor drum 5. Also in FIG. 2, numeral 9 denotes a developing and cleaning unit, 10-1 denotes a charge eraser for erasing the charge on the copy paper arranged close to the copying unit, 11 denotes a cassettes where a lot of paper are taken in, and 12 denotes a feeding roller. Numeral 13 denotes a transfer roller, 13-1 denotes a roller for transferring the copy paper synchronizing the rotation of the photoreceptor drum 5, 14 denotes a charge eraser, 15 denotes a lump for erasing the charge on the copy paper, 16 denotes a fixing roller, 17 denotes a discharge roller, and 18 denotes a tray for discharged paper. In the copying machine, the original platform 4 is moved in accordance with the rotation of the photoreceptor drum 5 and the image of the original is focused on the photoreceptor drum 5, then the image is copied on the copy paper. A zooming lens is used in the optical system 8 in order to change the copy magnification rate. In the optical system 8, of course, the other lens can be used.

Figure 3:
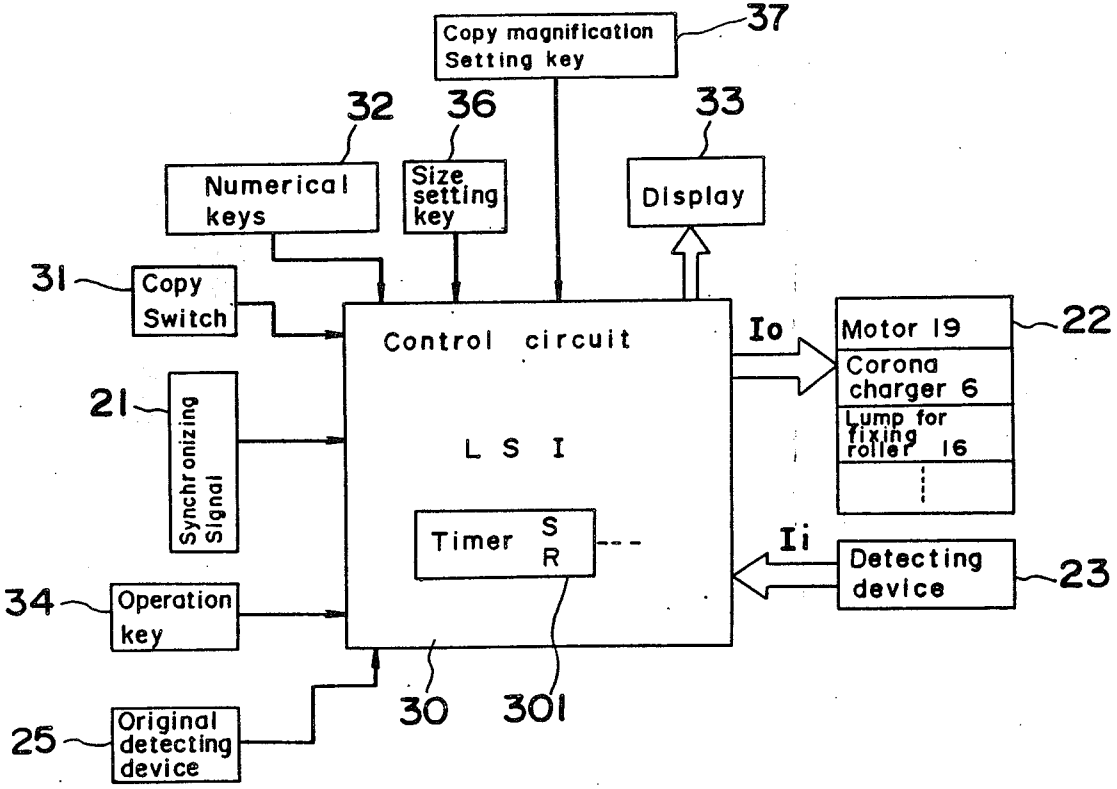
FIG. 3 is a schematic block diagram of a copying control device according to the present invention.
Figure 5:
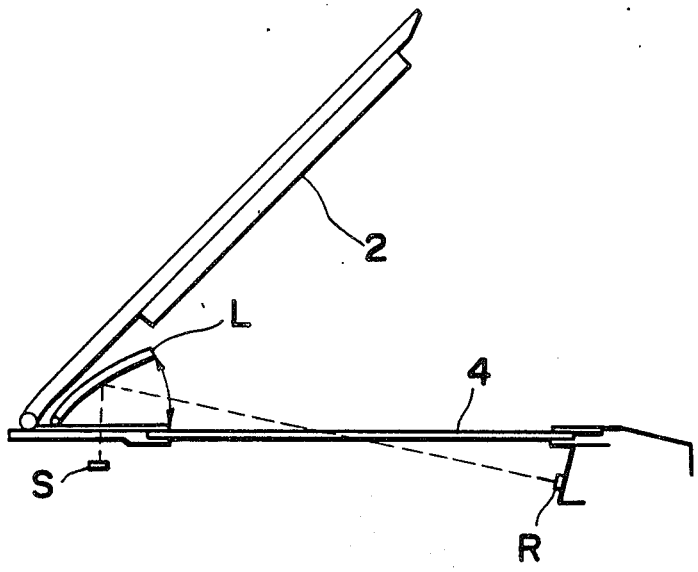
FIG. 5 is a schematic partial side view showing an embodiment of original detecting device used in the copying machine according to the present invention.

In the embodiment, an original detecting device 25 is arranged as shown in FIG. 3, which outputs the information of presence or absence of an original placed on the original platform 4 to a control circuit 30 (described in the following) in the copying machine. As shown in FIG. 5, the original detecting device 25 comprises a pair of a light emitting element S and a light receiving element R, wherein the light emitting element S emits an infrared ray to a reflecting plate L which is moved in accordance with the opening or closing of the original pressing cover 2 as shown in FIG. 5. The light emitting element S and the light receiving element R are arranged so that the infrared ray, which is outputted from the light emitting element S and is reflected at the reflecting plate L, passes the center or near the center of the original setting area on the original platform 4, and is received at the light receiving element R.

The above mentioned arrangement of the light emitting element S and the light receiving element R can detect the presence or absence of the original on the original platform 4. The original detection is performed when the original pressing cover 2 is closed. After an original is set on the original platform 4, the original pressing cover 2 is closed. The cover 2 is then positioned at a predetermined angle which presses the reflecting cover L so that the ray of light emitted from the light emitting element S is reflected at the reflecting plate L and is received by the light receiving element R. If the ray of light is received by the light receiving element R, it is determined that an original is not set on the original platform. On the other hand, if the ray is not received at the light receiving element R it is determined that the, original is set on the original platform 4. As outlined in the above mentioned process, the original on the orignal platform 4 is detected and an original detecting signal is outputted to the control circuit 30 in the copying machine along with the various information signals for copying, such as information of the numeral key 32 for setting the number of copy paper, the copy density setting key 35 (for lighter or darker copies), the size selecting key 36, or the copy magnification setting key 37 etc. In the copying machine according to the present invention, the original detecting signal and the other information signals from key operation for copying function as an order signal for a warming up operation.

In the copying machine according to the present invention, as soon as the signals, such as the original detecting signal and the other various information for copying (excluding the copy switch) are inputted to the control circuit 30 in the copying machine, the warming up operation is performed before copying. In general, when the copy operation is performed. This operation is thus performed the original is set on the original platform 4 and the original pressing cover is closed before the copy switch is operated. Then the presence of the original is detected by the original detecting device 25, the information signal is outputted to the control circuit 30 in the copying machine. Moreover, before or after the original is set, the various information for copying is inputted by using the keys such as the numeral keys 32 for setting the number of copy paper, the copy density setting key 35, the size selecting key 36, the copy magnification setting key 37 etc. That is, the information of key operation and the original detecting information are inputted to the control circuit 30 in the copying machine before the copy switch is operated, the warming up operation is performed as soon as the said information is inputted to the control circuit 30 in the copying machine.

In the following, the operation of the copying machine according to the present invention will be described briefly. After the copy switch 31 is operated, a motor drive signal is outputted from the control circuit 30 to a motor as shown in FIG. 3, the motor 19 is rotated and the photoreceptor drum 5 is rotated by transferring the rotation of the motor 19 via a transferring means (not shown). As soon as a signal designating the position of the rotating photoreceptor drum 5 is inputted to the control circuit 30 as a synchronizing signal 21, the control circuit 30 outputs a control signal $I_0$ for controlling the devices and transferring system etc. sequentially which are arranged in the surrounding of the photoreceptor drum 5. The control signal $I_0$ is inputted to the devices via a driving circuit 22. Then the copy operation is performed, a signal $I_i$ outputted from a detecting device 23 which detects the copy operation at each device is inputted to the control circuit 30, the control circuit 30 controls each device in turn in accordance with the signal $I_i$.

In the copying machine according to the present invention, the control circuit 30 performs the following operation as well as the control operation. That is, as soon as one of the key input operation signal (such as the numeral keys 32, the size selecting key 36, the copy magnification setting key 37 etc.) and the original detecting information signal designating the presence of the original on the original platform 4 are inputted to the control circuit 30, the control circuit 30 sets a timer 301 in the control circuit 30. The control circuit 30 controls the devices such as the motor 19 for rotating the photoreceptor drum 5, the corona charger 6, the lump for the fixing roller 16 etc. for a predetermined time. The timer 301 permits these devices to perform the warming up operation. Whenever the copying machine is used, an operator operates the numeral keys 32 for setting the number of copy paper, the copy density setting key 35, the size selecting key 36, the copy magnification setting key 37 etc. before a copy operation and sets the original on the original platform 4 before or after copy operation. The warming up operation is performed in accordance with the operator's operation of setting the original on the original platform and operating the keys, such as the numeral keys 32 for setting the number of copy paper, the copy density setting key 35, the size selecting key 36, the copy magnification setting key 37 etc. The control circuit 30 set the timer 301 in accordance with the operation of the operation and key 34 after the copy operation, the control circuit 30 controls the devices continuously for a predetermined time so that the devices perform the warming up operation.

Figure 6:
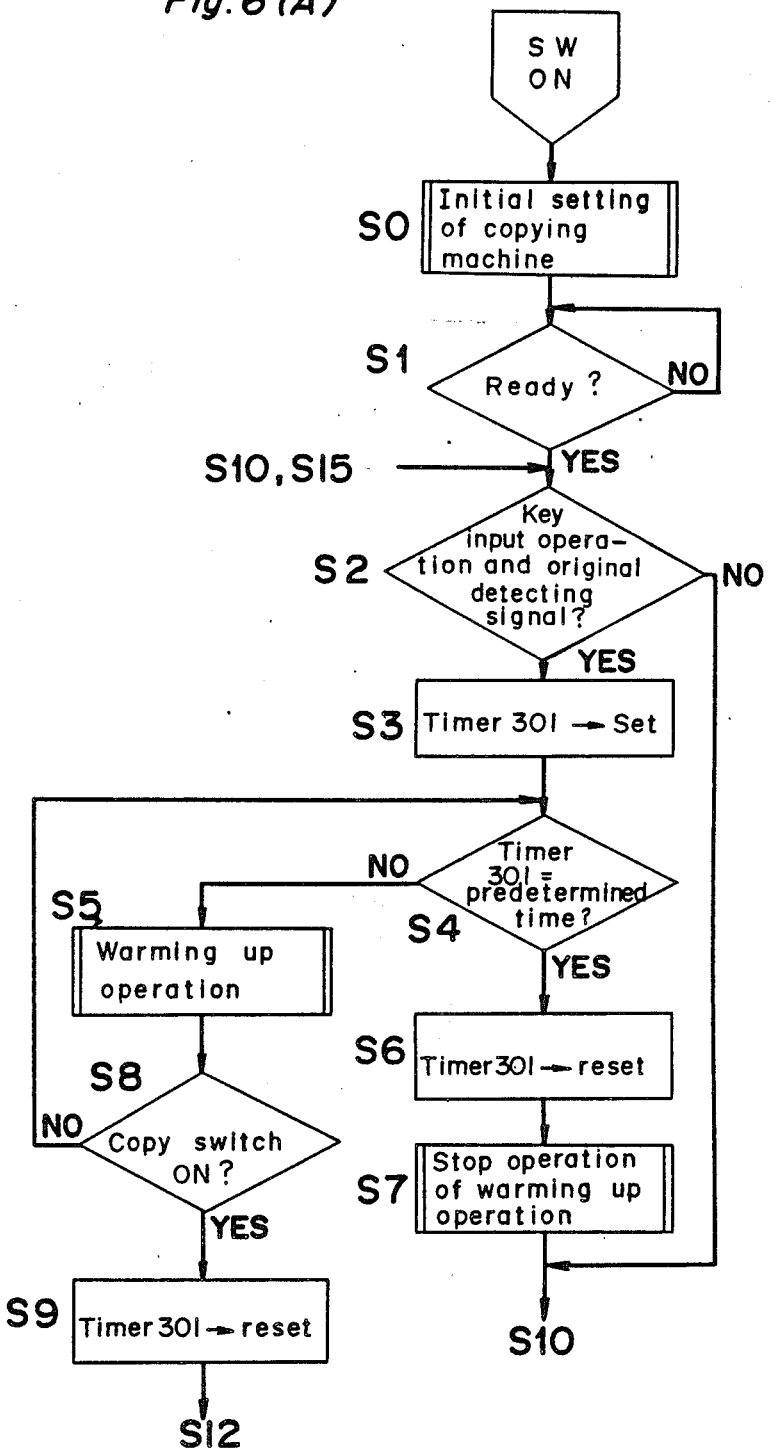
FIG. 6 is a flow chart showing an operation of the copying control device shown in FIG. 3.
Figure 6B:
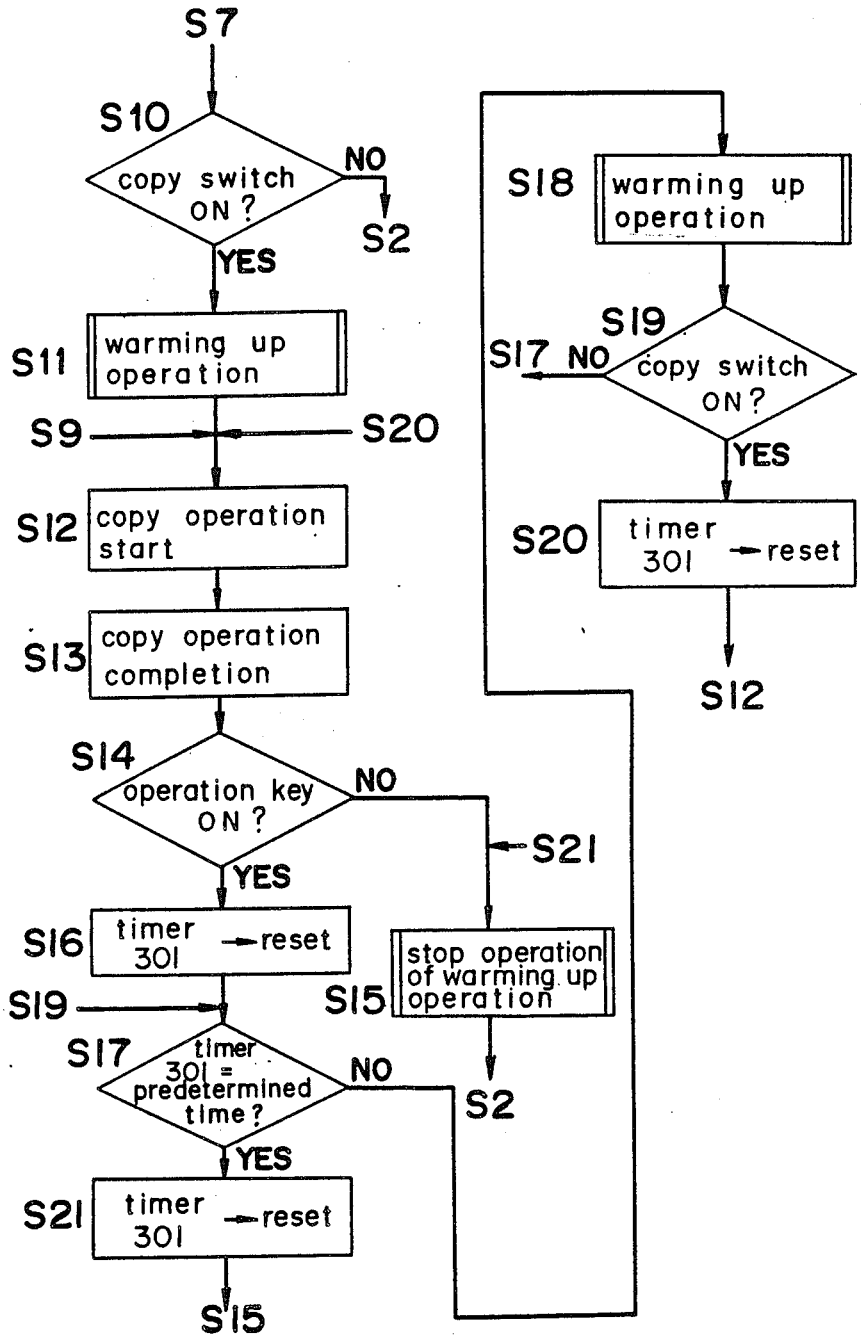

FIG. 6 is a flow chart showing the control operation in the copying machine according to the present invention. Referring to FIG. 6, after a power switch of the copying machine is turned on, the control circuit 30 sets a initial condition of the copying machine and judges whether or not the copying machine is in the ready condition. This ready condition corresponds to the condition in which the copying machine can start to copy at the step S1. After the copying machine is in the ready condition, step S2, it is judged if an operator operates any one of the numeral keys 32 for setting the number of copy paper, the copy density setting key 35, the size selecting key 36, the copy magnification setting key 37 etc. and/or if an operator sets an original on the original platform 4. Before or after the key input operation, an operator may set an original on the original platform 4. By the operation of setting the original on the original platform 4, the original detecting device 25 outputs the original detecting signal to the control circuit 30 and the key input operation signal is inputted to the control circuit 30 with the original detecting signal.

Normally, before the copy switch 31 is operated in order to copy, the original is set on the original platform 4, before or after the key input operation of the numeral keys 32 for setting the number of copy paper, the copy density setting key 35, the size selecting key 36, or the copy magnification setting key 37 etc. is performed. As soon as the information of the original detecting signal and the key input operation is inputted at the step S2, the program flow goes to the step S3. In step S3, then the timer 301 is set and starts. At the step S4, it is judged if the timer 301 has counted a predetermined time or not. The warming up operation is performed for the said predetermined time at the step S5. If any one of the numeral keys 32 for setting the number of copy paper, the copy density setting key 35, the size selecting key 36, and the copy magnification setting key 37 etc. is operated and the original detecting signal is inputted to the control circuit 30 before copying operation is started, the warming up operation is performed before the copy switch 31 is operated. The warming up operation is performed for the predetermined time set by the timer 301. If the copy switch 31 is operated during the predetermined time of the timer 301, the program flow goes from the step S8 to the step S9, then the timer 301 stops and is reset. After the warming up operation, at the step S9, the copy operation for copying the predetermined number of copy paper is performed.

The warming up operation is performed in order to perform the copy operation as soon as the copy switch 31 is operated, and the following operation is performed in the warming up operation. That is, the photoreceptor drum 5 is rotated by the motor 19 without transferring the copy paper, the corona charger 6 is turned on, the lump for the fixing roller 16 is turned on, and so on. Then the copy unit 9 etc. is made to stop if it is necessary. The said warming up operation is set about and performed in accordance with the control signal $I_0$ outputted from the control circuit 30. As mentioned above, if the copy switch 31 is operated during the predetermined time of the timer 301, the program flow goes from the step S8 to the step S9, then the timer 301 is reset. After the timer 301 is reset, the program flow goes to the step S12, then the copy operation is set about. After the warming up operation is performed and the position of the rotating photoreceptor drum 5 reaches a initial position, the copy operation is set about.

As mentioned above, it is not necessary that the warming up operation is performed after the copy switch 31, as soon as the copy switch 31 is operated, the copy operation is performed. Accordingly, the above mentioned process reduces the copying time to complete the second or additional copy of original.

After the timer 301 is set at the step S3, if the copy switch 31 is not operated during the predetermined time of the timer 301, that is, if the timer 301 has counted out, the program flow goes from the step S4 to the step S6. After the timer 301 is reset, a stop operation of the warming up operation is performed at the step S7. Then at the step S10 it is judged if the copy switch 31 is operated again, if it is not operated, the program flow goes back to S2. Therefore, in case any key is not operated and the original detecting signal is not inputted to the control circuit 30, the program flow cycles as S10→S2→S10. In the cyclic flow, if some key is operated and the original detecting signal is inputted to the control circuit 30, the warming up operation is performed before the copy switch 31 is operated as mentioned above.

After the copy completion operation is performed at the step S13, the program flow goes to the step S14. At the step S14, if the operation key 34 for performing the warming up operation is operated, the program flow goes to the step S16, then the timer 301 is set and starts. After that, at the step S17, it is judged if the timer 301 has counted the predetermined time. If the timer 301 has not counted the predetermined time, the program flow goes to the step S18. At the step S18 the warming up operation is performed and it is judged if the copy switch is operated at the step S19. Then if the copy switch 31 is not operated, the program flow goes to the step S17. That is, if the copy switch 31 is not operated until the timer 301 counts out, the program flow cycles as S17→S18→S19 →S17. When the copy operation for copying plural paper is performed, the original is changed on the original platform 4 while the warming up operation is being performed. Then if the copy switch 31 is operated during the predetermined time of the timer 301, the program flow goes from the step S19 to the step S20, then the timer 301 is reset. After the timer 301 is reset, the program flow goes to the step S12. At the step S12, the copy operation is performed.

As mentioned above, when a plurality of originals are to be copied, in case of copying of the second or additional copy of the original, the copy operation can be performed without performing the warming up operation after the copy switch 31 is operated. Therefore, it takes almost the same time to complete the first copy of the original as the time to complete the second or additional copy of the original.

After the timer 301 is set and starts, at the step S17, if it is judged that the timer 301 has counted the predetermined time, that is, if the timer 301 has counted out, the timer 301 is reset at the step S21. Then the program flow goes to the step S15, the stop operation of the copying machine is performed. After the operation of the step S15, the program flow cycles as S2→S10→S2 waiting the key operation and the original detecting signal.

The predetermined time of the timer 301 can be set, which is more than the time to change the original on the original platform 4. In the copying machine, the control circuit 30 comprises the timer 301, however, the timer 301 can be arranged to be separated from the control circuit 30 and the control circuit 30 can control the timer 301 so that the control circuit 30 outputs the set or reset signal to the the timer 301. In this case, after the timer 301 has counted the predetermined time, the timer 301 outputs a count out signal to the control circuit 30, then the control circuit 30 performs the stop operation of the copying machine.

A flip flop circuit or sort of the circuit can be arranged in order to store the information that the operation key 34 for performing the warming up operation is operated. The flip flop circuit can be set as soon as the operation key 34 is operated, then the set output of the flip flop circuit is outputted to the control circuit 30. On the other hand, the flip flop circuit can be reset as soon as the timer 301 has counted the predetermined time and the count out signal is inputted to the flip flop circuit. That is, the flip flop can be reset at the same time that the timer 301 is reset at the step S21 as shown in FIG. 6. However, the flip flop can not be reset at the same time that the timer 301 is reset at the step S20.

In the embodiment, the operation key 34 for performing the warning up operation is arranged and the warning up operation is continuously performed after a copy operation. However, the operation key 34 can not be arranged. That is, after a copy operation is completed, the program flow goes from the step S13 to the step S16, then the timer 301 can be set and the program flow cycles as S17→S18→S19–S17. Therefore, the warming up operation is performed continuously after the copy operation is completed. Moreover, if the change original is changed within the predetermined time of the timer 301 and the copy switch 31 is operated, as mentioned above, the program flow goes as S19→S20→S12 and the copy operation is set about after the warming operation.

Figures 6C, 6D:
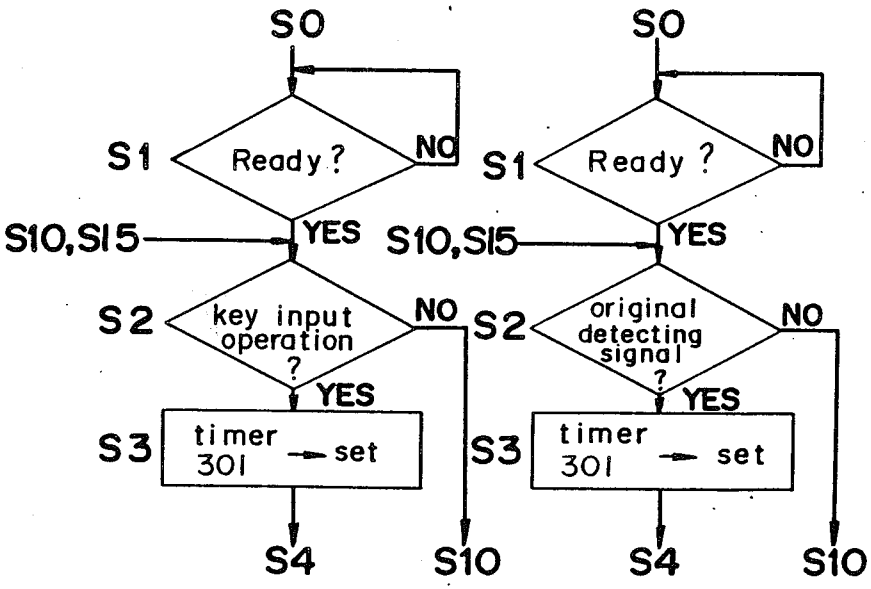

In FIG. 6(A), at step S2, it is judged if any one of the numeral keys 32 for setting the number of copy paper, the copy density setting key 35, the size selecting key 36, and the copy magnification setting key 37 etc. is operated and if the original detecting signal is inputted to the control circuit 30 after the original is set on the original platform 4. If any one of the said keys is operated and the original detecting signal is inputted, the warming up operation is set about as mentioned above. The said judgment of the step S2 can be that it is only judged if any one of the said keys is operated as shown in FIG. 6(C), or it is only judged if the original detecting signal is inputted to the control circuit 30 as shown in FIG. 6(D), if it is necessary. Therefore, in FIG. 6(C), if any one of the said keys is operated, the warming up operation is performed. On the other hand, in FIG. 6(D), if the original detecting signal is inputted to the control circuit 30, the warming up operation is performed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrophotographic copying machine for making at least one copy of an original located on an original platform, said copying machine comprising means for performing a warming up operation of necessary devices including a photoreceptor drum and fixing device provided in the copying machine, means for performing copying operation in accordance with an operation of a copy switch and control means for performing the said warming up operation in accordance with an order signal generated before the operation of the copy switch, said order signal of the warming up operation is a signal generated by an original detection means for detecting presence of said original on the original platform.

2. An electrophotographic copying machine for making at least one copy of an original located on an original platform, said copying machine comprising means for performing a warming up operation of necessary devices including a photoreceptor drum and fixing device provided in the copying machine, means for performing copying operation in accordance with an operation of a copy switch and control means for performing the said warming up operation in accordance with an order signal generated before the operation of the copy switch, said order signal of the warming up operation is a signal outputted from any one of the keys for setting various information for copying.

3. The electrophotographic copying machine as defined in claim 2, wherein said signal outputted from any one of the keys is a signal from a key for setting a number of copy paper.

4. The electrophotographic copying machine as defined in claim 2, wherein said signal outputted from any one of the keys for setting information for copying is a signal for setting copy magnification.

5. The electrophotographic copying machine as defined in claim 2, wherein said signal outputted from any one of the keys for setting various information for copying is a signal for selecting size of copy paper.

6. An electrophotographic copying machine for making at least one copy of an original located on an original platform, said copying machine comprising means for performing a warming up operation of necessary devices including a photoreceptor drum and fixing device provided in the copying machine, means for performing copying operation in accordance with an operation of a copy switch and control means for performing the said warming up operation in accordance with an order signal generated before the operation of the copy switch, said order signal of the warming up operation is a logical product of the signal of the original detecting means and the signal of any one of the keys for setting various information for copying.

* * * * *